US010188249B2

(12) United States Patent
Son et al.

(10) Patent No.: US 10,188,249 B2
(45) Date of Patent: Jan. 29, 2019

(54) VACUUM CLEANER

(71) Applicant: LG ELECTRONICS INC., Seoul (KR)

(72) Inventors: Jungkyu Son, Seoul (KR); Bohyun Nam, Seoul (KR); Jaeyong Park, Seoul (KR); Sehwan Bae, Seoul (KR); Geunyong Jung, Seoul (KR); Gunho Ha, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/445,631

(22) Filed: Feb. 28, 2017

(65) Prior Publication Data

US 2017/0245716 A1 Aug. 31, 2017

(30) Foreign Application Priority Data

Feb. 29, 2016 (KR) ..... 10-2016-0024022
May 16, 2016 (KR) ..... 10-2016-0059835

(51) Int. Cl.

| | |
|---|---|
| ***A47L 9/28*** | (2006.01) |
| ***A47L 5/36*** | (2006.01) |
| ***A47L 9/00*** | (2006.01) |
| ***A47L 9/10*** | (2006.01) |
| ***A47L 9/14*** | (2006.01) |
| ***A47L 9/24*** | (2006.01) |

(52) U.S. Cl.

CPC ..... *A47L 9/2873* (2013.01); *A47L 5/362* (2013.01); *A47L 9/009* (2013.01); *A47L 9/102* (2013.01); *A47L 9/1409* (2013.01); *A47L 9/242* (2013.01); *A47L 9/2805* (2013.01); *A47L 9/2884* (2013.01); *A47L 2201/022* (2013.01); *A47L 2201/04* (2013.01)

(58) Field of Classification Search

CPC ..... A47L 9/2873; A47L 9/2805; A47L 9/009; A47L 9/242; A47L 9/2884; A47L 5/362; A47L 9/102; A47L 9/1409; A47L 2201/04; A47L 2201/022; A47L 9/28

USPC ..... 15/DIG. 1, 339

See application file for complete search history.

(56) References Cited

FOREIGN PATENT DOCUMENTS

| | | |
|---|---|---|
| CN | 101554306 | 10/2009 |
| CN | 102227184 | 10/2011 |
| CN | 204169778 | 2/2015 |
| JP | 2002-028121 A | 1/2002 |
| JP | 2003219999 | 8/2003 |
| JP | 2015-012946 | 1/2015 |
| JP | 2015096132 | 5/2015 |
| KR | 0702733 | 4/2007 |
| KR | 0876695 | 12/2008 |

(Continued)

OTHER PUBLICATIONS

Office Action in Australian Application No. 2017226605, dated Nov. 14, 2018, 3 pages.

*Primary Examiner* — David Redding
(74) *Attorney, Agent, or Firm* — Fish & Richardson P.C.

(57) ABSTRACT

A vacuum cleaner includes: a cleaner body including a battery chamber; a motor provided in the cleaner body to provide suction force; a battery detachably mounted in the battery chamber to provide electric power to the motor; a battery cover rotatably mounted in the cleaner body to open and close the battery chamber; and a charging stand on which the cleaner body is held and which includes an opening prevention rib located on a rotation path of the battery cover in a state in which the cleaner body is held on the opening prevention rib and preventing opening of the battery cover.

19 Claims, 12 Drawing Sheets

(56) References Cited

FOREIGN PATENT DOCUMENTS

| | | |
|---|---|---|
| KR | 20-0450573 | 2/2009 |
| KR | 1552437 | 9/2015 |
| TW | 572746 | 1/2004 |
| WO | 2017-150829 | 9/2017 |

VACUUM CLEANER

CROSS-REFERENCE TO RELATED APPLICATIONS

This application claims priority under 35 U.S.C. 119 and 35 U.S.C. 365 to Korean Patent Application No. 10-2016-0024022 filed on Feb. 29, 2016 in Korea, and Korean Patent Application No. 10-2016-0059835 filed on May 16, 2016 in Korea, the entire contents of which are hereby incorporated by reference in its entirety.

BACKGROUND

The present application relates to a vacuum cleaner.

In general, a vacuum cleaner refers to a device for sucking dust and foreign materials from a surface to be cleaned using a suction motor provided in a main body and filtering dust and foreign materials in the main body.

The vacuum cleaner may be classified into an up-right type vacuum cleaner having a suction nozzle connected to a main body thereof and moving along with the main body and a canister type vacuum cleaner having a suction nozzle connected to a main body through an extension pipe, a handle, a hose, etc.

A vacuum cleaner is disclosed in Korean Patent Publication No. 10-1552437.

The vacuum cleaner of the related art includes a cleaner body including a suction motor for generating suction force, a suction part communicating with the cleaner body to suck in air and dust, a connection part for connecting the suction part and the cleaner body, and a battery provided in the cleaner body to supply power to the suction motor.

Meanwhile, in order to replace the battery or charge the battery using a charger, the battery should be detached from the cleaner body.

However, in the related art, since a battery assembly is provided in the cleaner body, the cleaner body should be disassembled in order to replace or repair a battery assembly, thereby causing user inconvenience.

SUMMARY

The present disclosure provides a vacuum cleaner capable of easily mounting a battery in a cleaner body thereof.

The present disclosure provides a vacuum cleaner in which a battery may be charged while a cleaner body is connected to a charging stand in a state in which the battery is mounted on the cleaner body.

The present disclosure provides a vacuum cleaner in which a battery charging terminal is exposed to the outside, when a cleaner body is mounted on a charging stand.

A vacuum cleaner includes: a cleaner body including a battery chamber; a motor provided in the cleaner body to provide suction force; a battery detachably mounted in the battery chamber to provide electric power to the motor; a battery cover rotatably mounted in the cleaner body to open and close the battery chamber; and a charging stand on which the cleaner body is held and including an opening prevention rib located on a rotation path of the battery cover in a state in which the cleaner body is held on the opening prevention rib and preventing opening of the battery cover.

A vacuum cleaner includes: a cleaner body having a suction motor for generating suction force; a suction part communicating with the cleaner body to suck air and dusts; moving wheels for moving the cleaner body; and a battery detachably mounted on a rear surface of the cleaner body to supply electric power to the cleaner body, wherein the cleaner body is rotated about a rotation center of the movable wheels, and a direction in which the battery is inserted into the cleaner body forms an acute angle with respect to a vertical line passing through a rotation center of the movable wheels.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Figure 1:
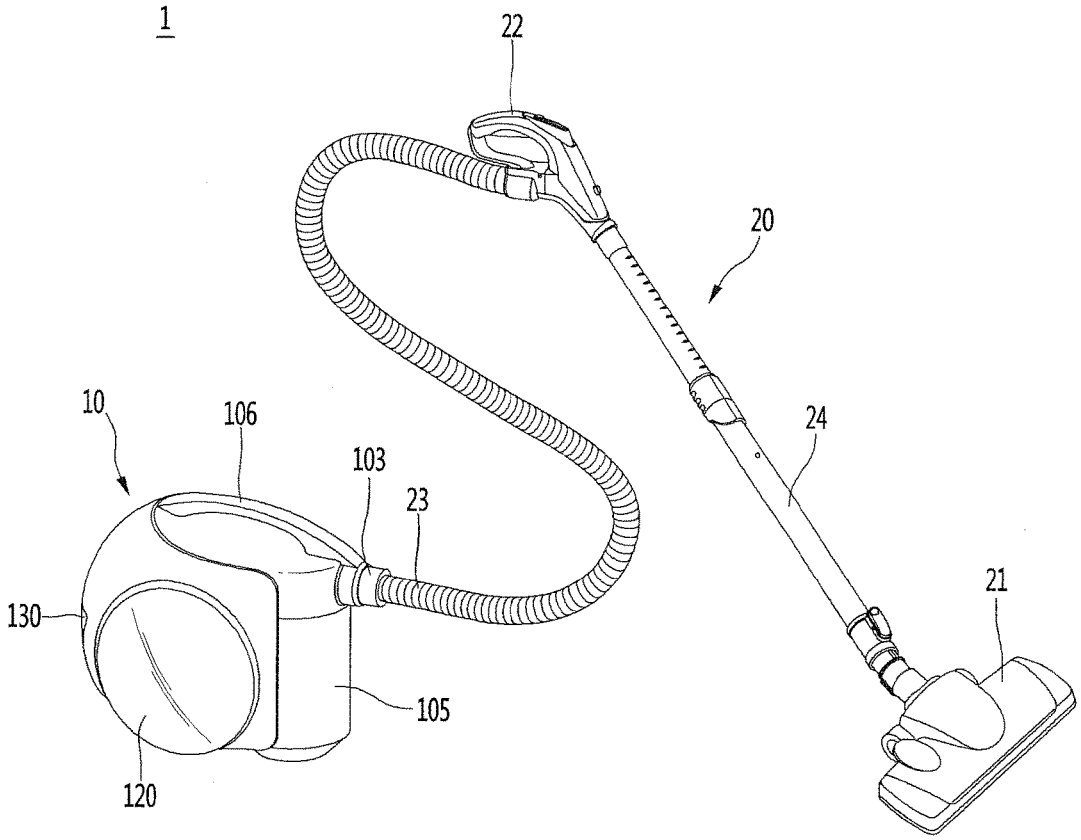
FIG. 1 is a perspective view of a vacuum cleaner according to an embodiment of the present invention.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

FIG. 1 is a perspective view of a vacuum cleaner according to an embodiment of the present invention.

Referring to FIG. 1, the vacuum cleaner 1 according to the embodiment of the present invention includes a cleaner body 10 and a suction device 20. The cleaner body 10 includes a suction motor for generating suction force. When the suction motor is driven to generate suction force, the suction device 20 may guide air including dust to the cleaner body 10.

The suction device 20 may include a suction part 21 for sucking dust off a surface to be cleaned, e.g., a floor, and connection parts 22, 23 and 24 for connecting the suction part 21 to the cleaner body 10. The connection parts 22, 23 and 24 may include an extension pipe 24 connected to the suction part 21, a handle 22 connected to the extension pipe 24 and a suction hose 23 for connecting the handle 22 to the cleaner body 10. The cleaner body 10 may include a connector 103 connected to the suction hose 23.

The cleaner body 10 includes moving wheels 120 and a battery 130.

The cleaner body 10 includes a dust container 105 in which dust sucked through the suction device 20 is stored. The dust container 105 may be detachably mounted in the cleaner body 110. In addition, the dust container 105 may be provided in front of the cleaner body 10 and may be made of a transparent material to enable a user to view the inside of the dust container 105.

The cleaner body 10 may include a grip part 106 to be gripped by the user. The user may grip the grip part 106 when the user wants to lift up or incline the cleaner body 10.

The cleaner body 10 may include a dust separator (not shown) for separating air and dust sucked by the suction device 20 from each other. The dust separator may be provided separately from or integrally with the dust container 105. For example, the dust separator is provided within the dust container 105.

The moving wheels 120 may be rotatably coupled to the cleaner body 10. The pair of moving wheels 120 may be provided and may be coupled to both sides of the cleaner body 10.

The battery 130 may be detachably coupled to the cleaner body 10. When the battery 130 is coupled to the cleaner body 110, the battery 130 may move together with the cleaner body 110.

The battery 130 may serve to supply power necessary to drive the vacuum cleaner 1. The battery 130 may be a secondary battery which may be charged or discharged. A power cord (not shown) for charging the battery 130 may be separately connected to the battery 130 or the cleaner body 10. Otherwise, the battery 130 may be mounted to a charging stand (not shown) after being separated from the cleaner body 110.

Figure 2:
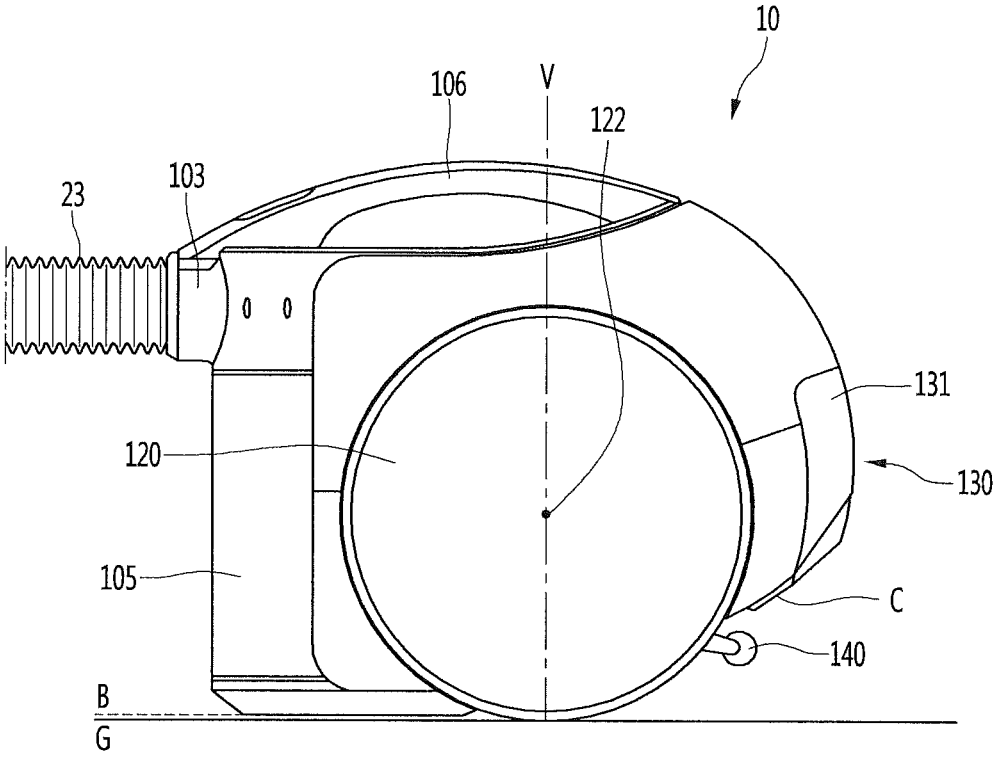
FIG. 2 is a view showing a state in which a main body of FIG. 1 is inclined forward.
Figure 3:
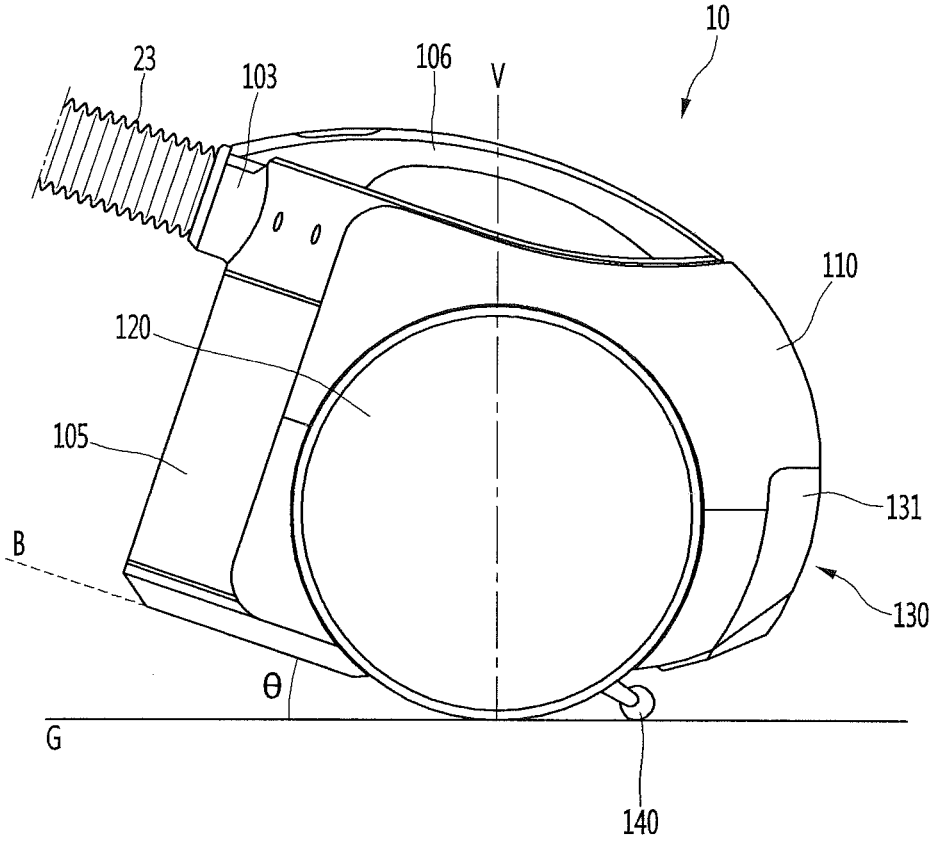
FIG. 3 is a view showing a state in which the main body of FIG. 1 is inclined backward.
Figure 4:
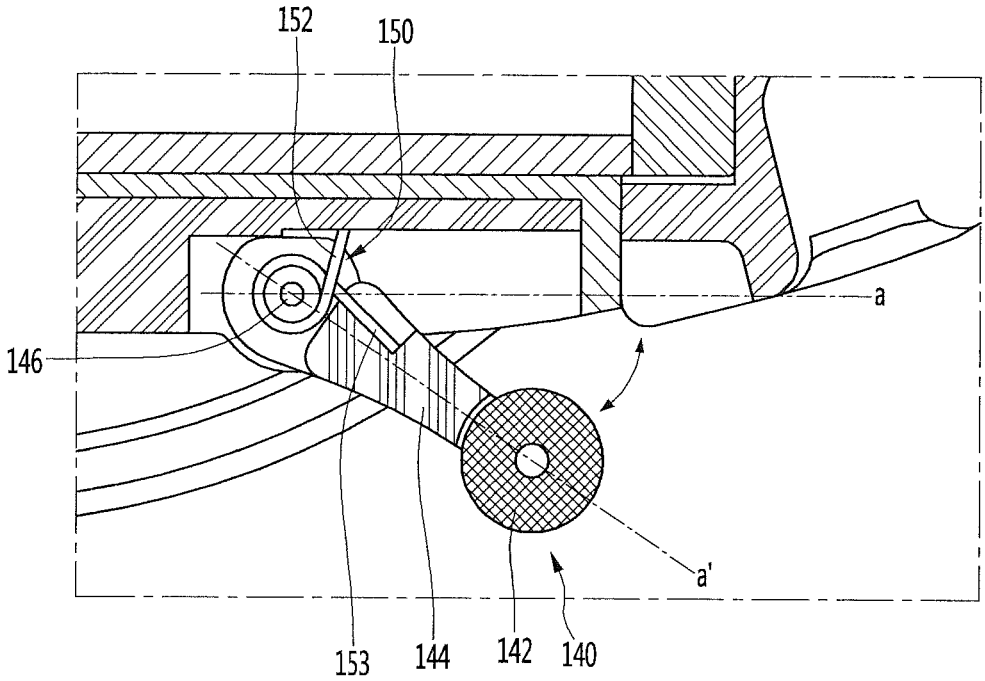
FIG. 4 is a view showing the configuration of a supporter of FIG. 3.

FIG. 2 is a view showing a state in which a cleaner body of FIG. 1 is inclined forward, FIG. 3 is a view showing a state in which the cleaner body of FIG. 1 is inclined backward, and FIG. 4 is a view showing the configuration of a supporter of FIG. 3.

Referring to FIGS. 2 to 4, at least a part of the bottom of the cleaner body 110 is separated from a floor.

The cleaner body 10 may be rotated to the front side or the back side of the moving wheels 120.

A part, in which the connector 103 is provided, of the cleaner body 10 with respect to a vertical line V passing through a rotation center 122 of the moving wheels 120 may be defined as a front side and a part, in which the battery 130 is provided, of the cleaner body 10 may be defined as a back side. In addition, the cleaner body 10 rotating forward means that the cleaner body 10 rotates in a counter-clockwise direction (see state of cleaner body of FIG. 2) in the figure and the cleaner body 10 rotating backward means that the cleaner body 10 rotates in a clockwise direction (see state of cleaner body of FIG. 3).

The cleaner body 10 may further include a driving unit (not shown) for driving the moving wheels 120.

The driving unit may be automatically controlled by a controller. Accordingly, the moving wheels 120 may be automatically driven along a direction desired by the user. That is, the controller may perform control such that the cleaner body 10 automatically follows motion of the user.

The cleaner body 10 may further include a sensor (not shown) for sensing motion of the cleaner body 10. The controller may control driving of the moving wheels 120 by sensing information sensed by the sensor.

The sensor may include a general gyro sensor for sensing a current angle and a current speed of the cleaner body 10 upon operating the cleaner body 10.

The gyro sensor senses angular velocity from the Coriolis force applied in a direction perpendicular to a direction in which a moving object rotates and may measure not only the angle of the moving object but also change in position of the moving object from a first reference point.

If the sensor is turned off, the moving wheels 120 may not be driven. In this case, the cleaner body 10 is inclined according to the position of the center of gravity thereof. For example, when the center of gravity of the cleaner body 10 is located at the front side of the vertical line V passing through the rotation center 122 of the moving wheels 120, the cleaner body 10 is inclined forward as shown in FIG. 2 and, when the center of gravity of the cleaner body 10 is located at the back side of the vertical line V, the cleaner body 10 is inclined backward as shown in FIG. 3.

The cleaner body 10 may include a first bottom B and a second bottom C. The second bottom C extends at a predetermined angle with respect to the first bottom B.

In the state shown in FIG. 2, the first bottom B is substantially aligned with the floor G. In contrast, the second bottom C is separated from the floor G and is inclined at a predetermined angle with respect to the floor G.

When the sensor is turned on, the controller may control driving of the moving wheels 120 such that the center of gravity of the cleaner body 10 is located on the vertical line V passing through the rotation center 122 of the moving wheels 120.

In this case, as shown in FIG. 3, the first bottom B of the cleaner body 10 may be separated from the floor G.

The cleaner body 10 may further include a supporter 140. The supporter 140 may extend from the second bottom C of the cleaner body 10. The supporter 140 may perform a function for restricting the angle at which the cleaner body 10 is inclined backward.

The supporter 140 may include an auxiliary wheel 142. The auxiliary wheel 142 may rotate by friction with the floor G. Therefore, the cleaner body 10 may be smoothly driven.

The supporter 140 may further include an extension 144. The auxiliary wheel 142 may be rotatably connected to one side of the extension 144.

The supporter 140 may further include a rotation shaft 146. The other side of the extension 144 may be rotatably connected to the cleaner body 10 by the rotation shaft 146.

The extension 144 may be rotated within a predetermined range. More specifically, the extension 144 may rotate upward or downward within a range of a to a'. The cleaner body 10 may include a stopper (not shown) for restricting the rotation range of the extension 144.

The supporter 140 may further include an elastic member 150. For example, the elastic member 150 may be a torsion spring.

One end 152 of the elastic member 150 may be supported by the cleaner body 10 and the other end 153 of the elastic member 150 may be supported by the extension 144. The elastic member 150 may apply elastic force such that the extension 144 rotates in a clockwise direction in the FIG. 4.

When the cleaner body 10 is inclined forward to the maximum extent, the bottom B of the cleaner body 10 may contact the floor G. Thus, the maximum angle of the cleaner body 10 rotated forward may be restricted.

In contrast, when the cleaner body 10 is inclined backward, the supporter 140 may contact the floor G. Thus, the maximum angle of the cleaner body 10 rotated backward may be restricted. Therefore, it is possible to prevent the cleaner body 10 from being overturned forward or backward.

Since elastic force of the elastic member 150 is applied to the extension 140 in a clockwise direction (see FIG. 4) in the figure, when the cleaner body 110 is excessively inclined backward, forward rotation force may be applied to the cleaner body 110 by the supporter 140.

When the cleaner body 110 rotates backward to the maximum extent, the bottom B of the cleaner body 10 forms a predetermined angle θ with respect to the floor G. At this time, the angle θ between the bottom B of the cleaner body 10 and the floor G may be about 17° to 20°.

The battery 130 may include a battery cover 131. In a state in which the battery 130 is mounted in the cleaner body 10, the battery cover 131 may be exposed to the outside. Thus, the battery cover 131 may form at least a part of the outer appearance of the cleaner body 10. In addition, the user may detach the battery 130 from the cleaner body 10 or attach the battery to the cleaner body 110 without disassembling the cleaner body 110. The battery cover 131 may include a grip part facilitating attachment and detachment of the battery 130 to and from the cleaner body 10.

Hereinafter, a process of attaching and detaching the battery 130 to and from the cleaner body 10 will be described in detail.

However, assume that the center of gravity of the cleaner body 10 is located at the front side of the cleaner body 10 when the battery 130 is detached from the cleaner body 10 and is located at the back side of the cleaner body 10 when the battery 130 is attached to the cleaner body 10.

Figure 5:
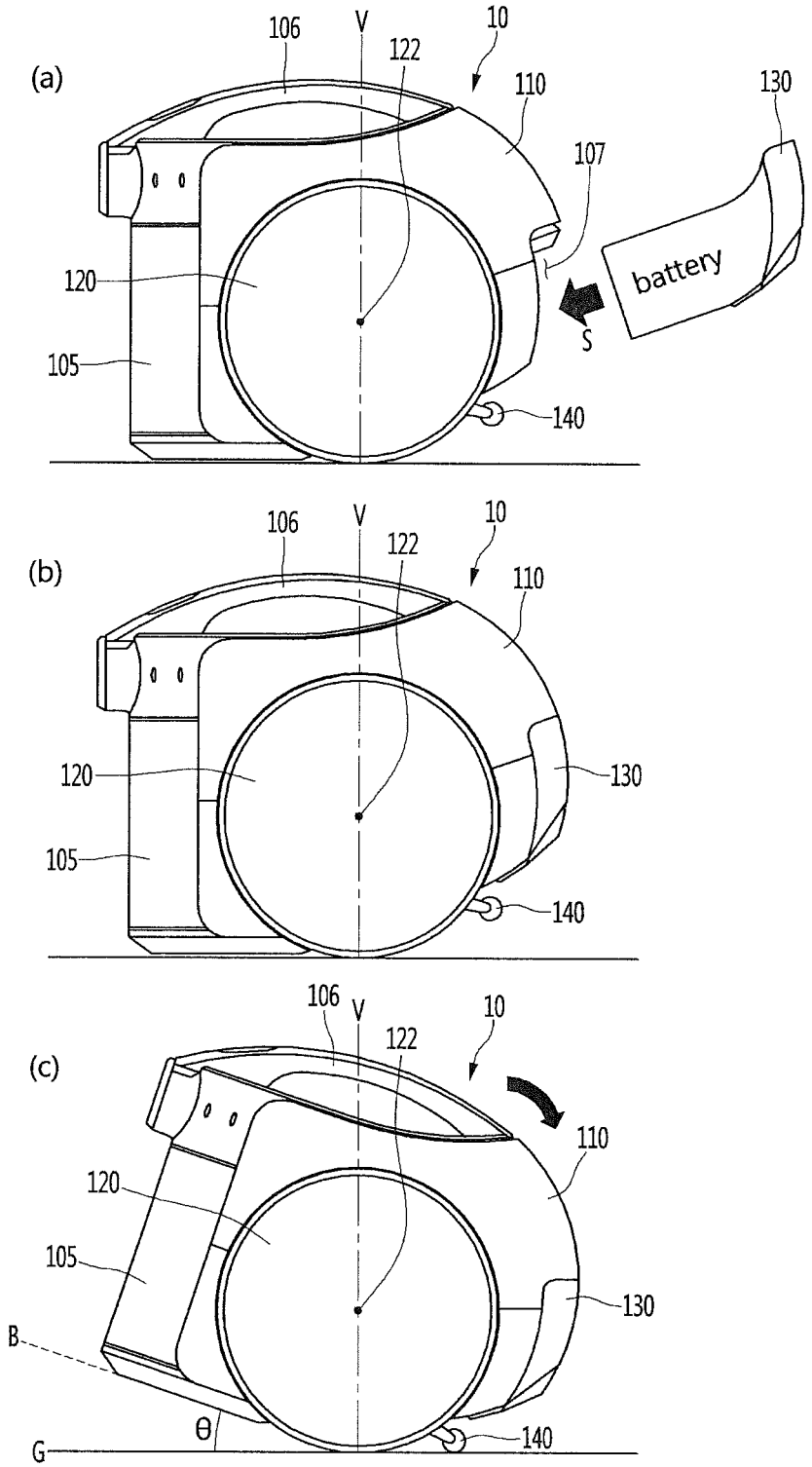
FIG. 5 is a view sequentially showing a state of attaching a battery to the cleaner body of the cleaner.

FIG. 5 is a view sequentially showing a state of attaching a battery to the cleaner body.

FIG. 5A shows a state in which the battery 130 is detached from the cleaner body 10, FIG. 5B shows a state in which the battery 130 is attached to the cleaner body 10, and FIG. 5C shows a state in which the cleaner body 10 is inclined backward.

Referring to FIG. 5, a battery attachment part 107 coupled with the battery 130 is formed in the cleaner body 110. The battery attachment part 107 may be formed by recessing a portion of the cleaner body 110. In addition, an attachment guide (not shown) for guiding attachment of the battery 130 may be formed in the battery attachment part 107.

The battery attachment part 107 is formed at the lower side of the cleaner body 10 and thus the battery 130 is attached to the lower side of the bottom of the cleaner body 110. For example, the center of gravity of the battery 130 may be located at the lower side of the rotation center of the moving wheels 120 in a state in which the battery 130 is mounted in the cleaner body 10.

Accordingly, when the battery 130 is attached to the cleaner body 10, the height of the center of gravity of the cleaner body 10 may be lowered, so that it is possible to improve driving stability of the cleaner body 10.

When the battery 130 is attached to the lower side of the main body 10, it is possible to improve driving stability. However, since the battery 130 is attached to the lower side of the cleaner body 110, user inconvenience may be caused upon attaching the battery 130.

However, in a state in which the battery 130 is detached from the cleaner body 10, the center of gravity of the cleaner body 110 may be located on the front side of the vertical line V passing through the rotation center of the moving wheels 120 (see FIG. 5A). Therefore, when the battery 130 is detached from the cleaner body 10, the cleaner body 10 may be inclined to the front side of the rotation center 122 of the moving wheels 120.

As the cleaner body 10 is inclined forward, the first bottom B of the cleaner body 10 contacts the floor. At this time, the battery attachment part 107 is inclined upward. Therefore, the user may easily attach the battery 130.

The battery 130 may be obliquely attached to the cleaner body 10 by the attachment guide provided in the battery attachment part 107. More specifically, the insertion direction S of the battery 130 may form an acute angle with respect to the vertical direction V and the floor. Accordingly, when the front side of the bottom of the cleaner body 10 contacts the floor, the insertion direction S of the battery 130 forms an acute angle with respect to the floor. @@@

When the battery 130 is attached to the cleaner body 10, the center of gravity of the cleaner body 10 may move backward. That is, in a state in which the battery 130 is attached to the cleaner body 10, the center of gravity of the cleaner body 10 may be located at the back side of the vertical direction passing through the center of the moving wheels 120.

That is, when the battery 130 is attached to the cleaner body 10, the cleaner body 10 may be inclined to the back side of the moving wheels 120. At this time, the supporter 140 may selectively contact the floor. At this time, the bottom B of the cleaner body 10 forms a predetermined angle θ with respect to the floor G.

Figure 6:
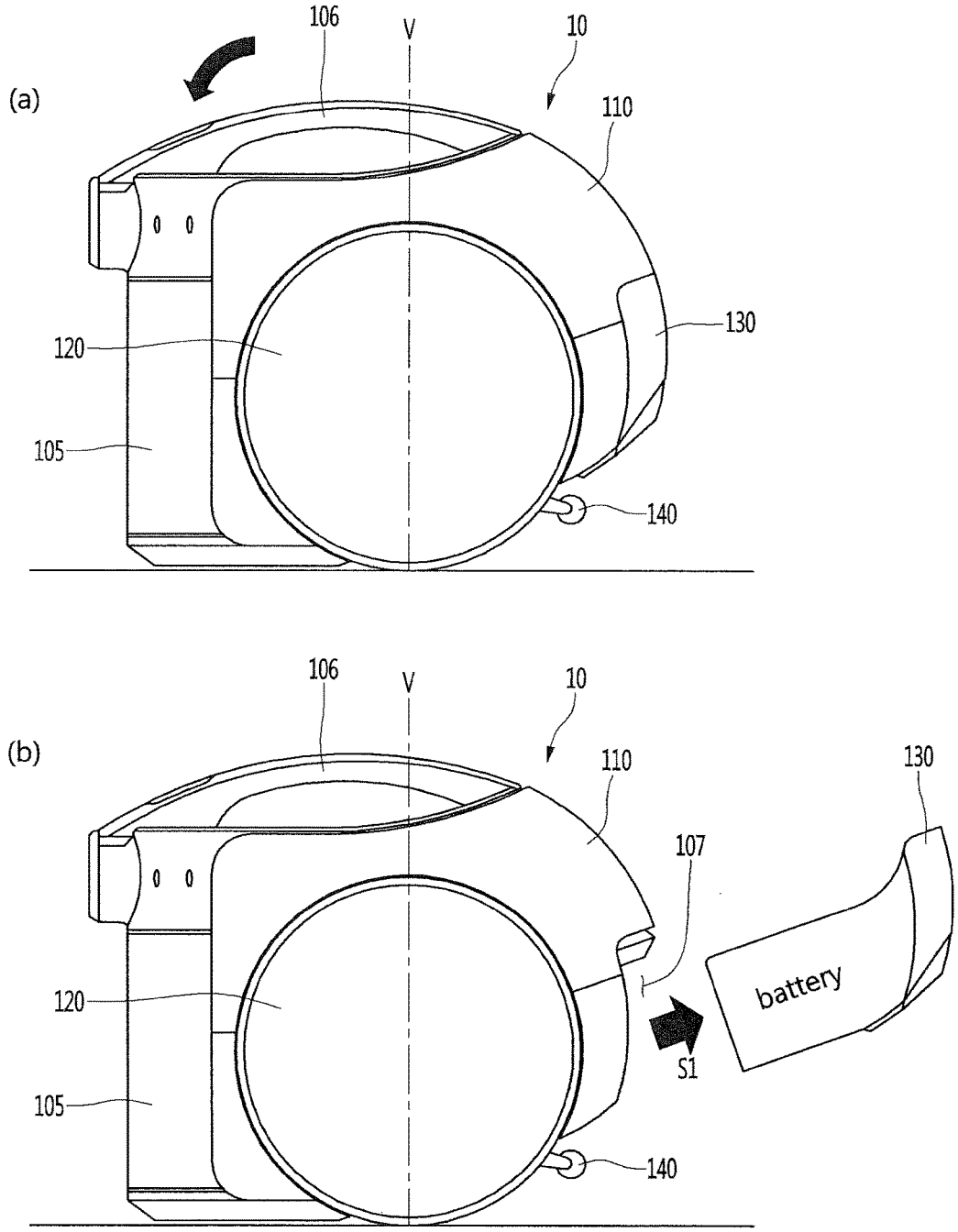
FIG. 6 is a view sequentially showing a state of detaching a battery from the cleaner body of the cleaner.

FIG. 6 is a view sequentially showing a state of detaching a battery from the cleaner body of the cleaner.

More specifically, FIG. 6A shows a state before the battery 130 is detached from the main body and FIG. 6B is a state after the battery 130 is detached from the cleaner body 10.

In order to detach the battery 130 from the cleaner body 10, the user may directly apply force to the cleaner body 10 to incline the cleaner body 10 forward. Next, the user may detach the battery 130 in a direction opposite to the insertion direction S. The user may grip the grip part 106 and then apply force forward in order to incline the cleaner body 10 forward.

When the battery 130 is detached from the cleaner body 10, the center of gravity of the cleaner body 10 moves forward. Therefore, the cleaner body 10 may be maintained in a forward inclined state.

In the vacuum cleaner 1 of the present invention, in the state in which the battery 130 is mounted in the cleaner body 10, the cleaner body 10 rotates backward such that the bottom of the cleaner body 10 is separated from the floor. That is, the cleaner body 10 may be two-point supported by the moving wheels 120. In this case, since the cleaner body 10 easily passes an obstacle and friction applied to the moving wheels 120 is reduced, it is possible to reduce user labor required to move the main body 10.

When the battery 130 is detached from the cleaner body 10, the center of gravity of the cleaner body 10 moves forward to rotate forward and thus the battery attachment part 107 provided at the lower back side of the cleaner body 10 is raised. Therefore, the user can easily attach the battery 130 to the battery attachment part 107.

Figure 7:
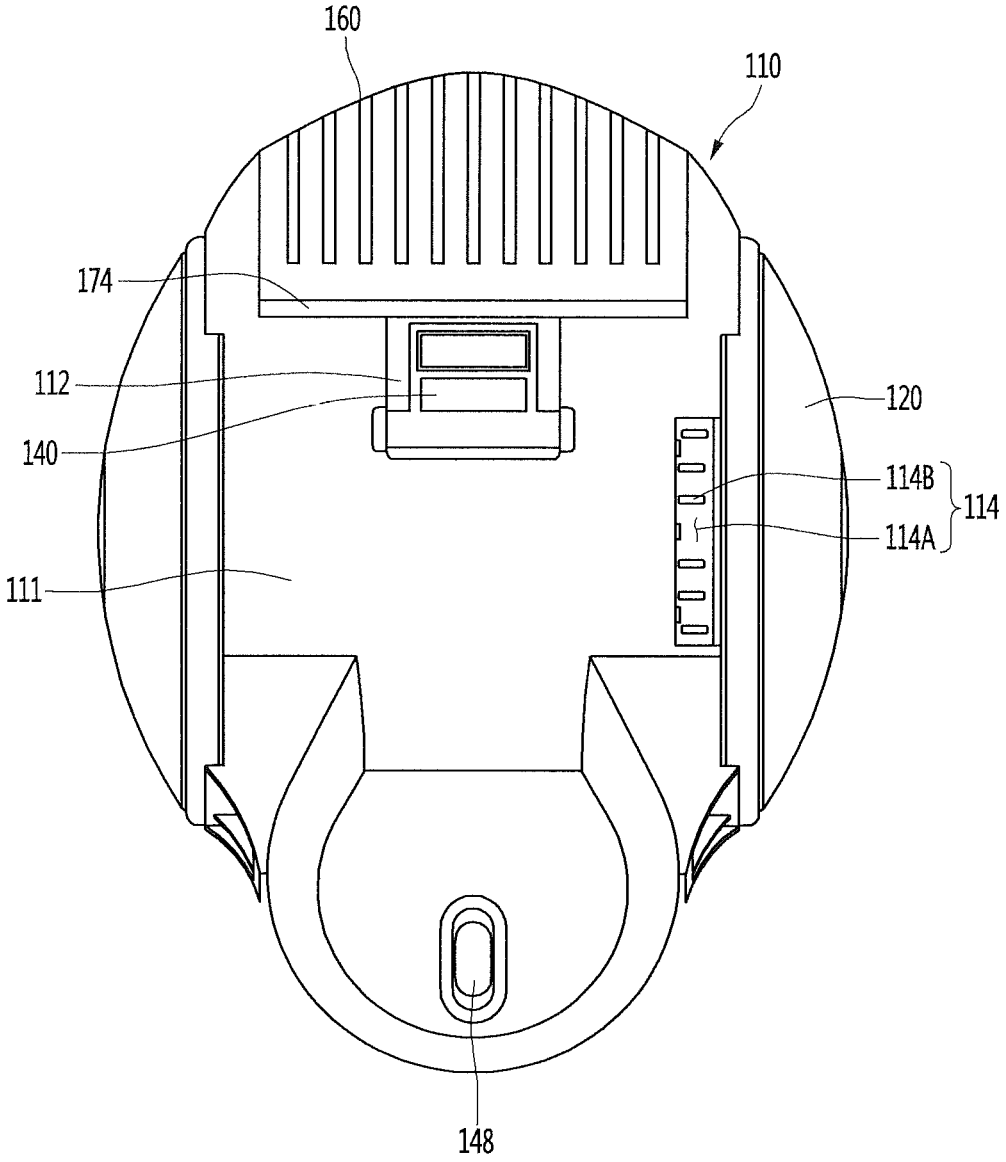
FIG. 7 is a bottom view illustrating a cleaner body according to another embodiment of the present disclosure.

FIG. 7 is a bottom view illustrating a cleaner body according to another embodiment of the present disclosure.

The present embodiment is characterized in that a battery cover is rotatably coupled to a cleaner body in a state in which a battery is not separated from the battery cover together, although other configurations according to the present embodiment are identical to those according to the prior embodiments. Thus, the present embodiment will be described below.

Referring to FIG. 7, a supporter 140 and an auxiliary wheel 148 may be provided on the bottom surface of the cleaner body 110 according to the embodiment of the present invention. The supporter 140 is located on a rear side of the auxiliary wheel 148.

The bottom surface of the cleaner body 110 may include a first surface 111 and a second surface 112 recessed upward from the first surface 111.

The auxiliary wheel 148 may be provided on the first surface 111, and the supporter 140 may be provided on the second surface 112.

As described in the prior embodiment, the cleaner body 110 may be rotated about the rotation center of the moving wheels 120.

Any one of the auxiliary wheel 148 and the supporter 140 may be in contact with the bottom surface depending on a rotation angle of the cleaner body 110.

As an example, when the cleaner body 110 is rotated as illustrated in FIG. 2, the auxiliary wheel 148 comes into contact with the bottom surface. Meanwhile, when the cleaner body 110 is rotated as illustrated in FIG. 3, the supporter 140 comes into contact with the bottom surface.

An input terminal part 114 to which electric power is applied may be provided on the bottom surface of the cleaner body 110. The input terminal part 114 may include an insertion groove 114A recessed upward from the bottom surface of the cleaner body 110 by a predetermined distance, and input terminals 114B arranged in the insertion groove 114A. An output terminal part 324 of a holding part 320 of a charging stand 300 may be coupled to the input terminal part 114 when the cleaner body 110 is held on the holding part 320. Detailed contents of the charging stand 300 will be described below.

Further, the cleaner body 110 may further include a battery cover 160. The battery cover 160 may be rotatably coupled to a lower side of the bottom surface of the cleaner body 110.

According to the present invention, because the center of gravity is located in front of the vertical line passing through the rotation center of the moving wheels in a state in which the battery is separated from the cleaner body, the battery may be easily coupled to the cleaner body.

Further, as the cleaner body is two-point-supported by the pair of moving wheels, the cleaner body may easily climb up an obstacle such as a thick carpet and a blanket and may be moved.

Further, because a mounting location of the battery is a lower side of the bottom surface of the cleaner body, the center of gravity of the cleaner body is moved downward, so that driving stability of the cleaner body may be improved.

Further, as the supporter is provided on the rear side of the bottom surface of the cleaner body, the cleaner body is prevented from being overturned rearward.

Figure 8:
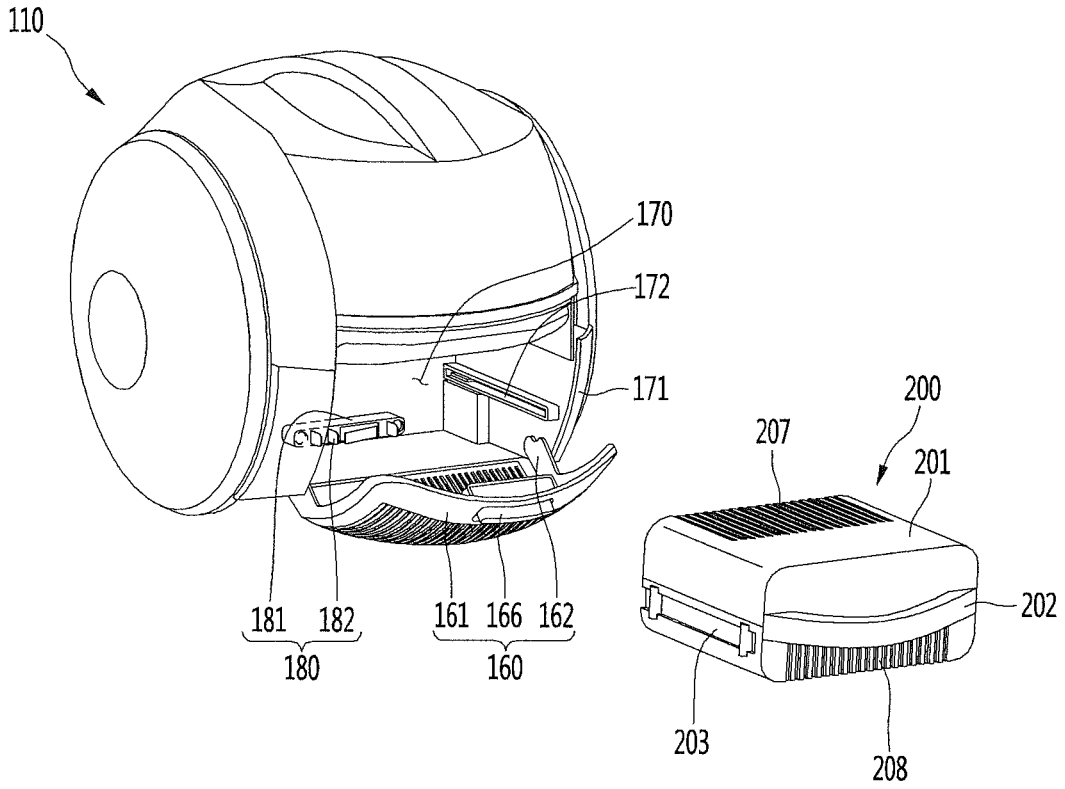
FIG. 8 is a perspective view illustrating a battery chamber from which a battery is separated according to another embodiment of the present invention.
Figure 9:
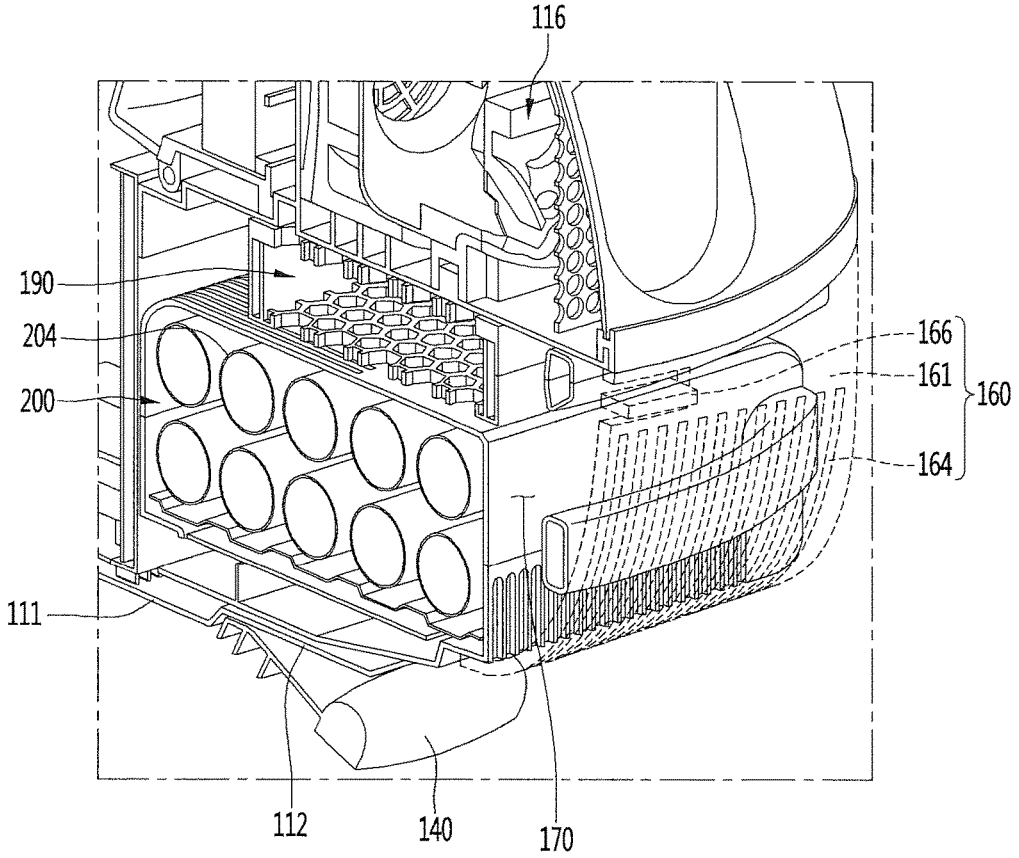
FIG. 9 is a view illustrating the battery chamber into which the battery is inserted according to another embodiment of the present invention.

FIG. 8 is a perspective view illustrating a battery chamber from which a battery is separated according to another embodiment of the present invention, and FIG. 9 is a view illustrating the battery chamber into which the battery is inserted according to another embodiment of the present invention.

Referring to FIGS. 8 and 9, the cleaner body 110 may further include a battery chamber 170 in which a battery 200 is accommodated.

The battery chamber 170 may be provided on the lower side of the bottom surface of the cleaner body 110. The battery chamber 170 may be opened/closed by the battery cover 160.

In the present invention, because a direction and an angle in which the battery 200 is mounted in or separated from the battery chamber 170, a state of the cleaner body 110 before the battery 200 is mounted and a state of the cleaner body 110 after the battery 200 is mounted may be identical or similar to those according to the prior embodiment, detailed descriptions thereof will be omitted.

The battery chamber 170 may be recessed inward from one surface of the cleaner body 110. As an example, the battery chamber 170 may be recessed forward from the rear surface of the cleaner body 110. Thus, an opening 171 may be provided on a rear side of the battery chamber 170, and the battery 200 may be input/output through the opening 171.

The battery chamber 170 may be located on a lower side of a motor 116 that provides suction force, and air passing through the motor 116 may flow to the battery chamber 170. A filter 70 may be provided between the motor 116 and the battery chamber 170.

The battery 200 which may supply electric power to the motor 116 may be selectively attached to or detached from an inside of the battery chamber 170.

The battery 200 may include a case 201 in which battery cells 204 are accommodated and a handle 202 formed on one side of the case 201. The plurality of battery cells 204 may be accommodated in the case 201. Each of the plurality of battery cells 204 may be a secondary battery that may be charged and discharged. The plurality of battery cells 204 may be arranged to vertically define a plurality of rows.

The handle 202 may be provided on the rear surface of the case 201.

The battery 200 may further include a battery terminal part (not illustrated). The battery terminal part may electrically connect the cleaner body 110 and the battery 200 to each other such that electric power of the battery 200 is supplied to the cleaner body 110 or the electric power applied to the cleaner body 110 during a charging operation is supplied to the battery 200. When the battery 200 is inserted into the battery chamber 170, the battery terminal part may be connected to a charging terminal part 180, which will be described below.

The battery 200 may further include fixing grooves 203 provided on both sides of the case 201. As an example, the fixing grooves 203 may be recessed inward from both sides of the case 201 by a predetermined depth, and may extend in a front-rear direction of the battery 200 with respect to FIG. 8. Here, the front-rear direction may mean a direction from the handle 220 to the battery terminal part or may mean a direction in which the battery 200 is inserted into the battery chamber 170.

The fixing grooves 203 may guide insertion/withdrawal of the battery 200.

The battery 200 may further include air inlet holes 207 and air outlet holes 208. The air inlet holes 207 allow external air of the battery 200 to be introduced into the battery 200, and the air outlet holes 208 allow internal air of the battery 200 to be discharged to the outside.

As an example, the air inlet holes 156 may be provided on an upper surface of the case 201, and the air outlet holes 157 may be provided on a rear surface of the case 201. Here, the upper surface may refer to a direction toward the motor 116 when the battery 200 is accommodated in the battery chamber 170, and the rear surface may refer to a direction toward the battery cover 160 when the battery 200 is accommodated in the battery chamber 170.

Meanwhile, the battery chamber 170 may further include a charging terminal part 180. The charging terminal part 180 may be electrically connected to the battery terminal part of the battery 200.

The charging terminal part 180 may be arranged inside the battery chamber 170.

The charging terminal part 180 includes a frame 181 arranged on one surface of the battery chamber 170 and charging terminals 182 fixed to the frame 181 and exposed to the battery chamber 170.

The frame 181 may protrude rearward from a front surface of the battery chamber 170 by a predetermined distance. However, the present invention is not limited thereto, and the frame 181 may have any shape that corresponds to the battery terminal part.

The plurality of charging terminals 182 may be provided, and may be inserted into the case 201 of the battery 200 through the battery terminal part when the battery 200 is inserted into the battery chamber 170.

As an example, when the cleaner body 110 fails to receive electric power from the charging stand 300, the cleaner body 110 receives electric power from the battery 200 through the charging terminal part 180, and when the cleaner body 110 receives electric power from the charging stand 300, the battery 200 is charged through the charging terminal part 180.

However, the present embodiment is not limited thereto, and even when the cleaner body 110 receives electric power from a commercial power source in addition to the charging stand 300, the battery 200 may be charged.

The battery chamber 170 may include battery fixing parts 172. The battery fixing parts 172 fix the battery 200 to the battery chamber 170.

The battery fixing parts 172 may be provided on opposite side surfaces of the battery chamber 170, and may protrude from the opposite side surfaces of the battery chamber 170 toward an inner space of the battery chamber 170.

Each battery fixing part 172 includes a slide fastened to the corresponding fixing groove 203 of the battery 200.

The slide may extend rearward from a front side of the battery chamber 170. While the battery 200 is fastened to the battery chamber 170, the slide is inserted into the fixing groove 203 to guide forward and rearward movement of the battery 200.

The battery cover 160 may include a cover body 161 and mounting parts 162 extending from one side of the cover body 161.

The cover body 161 may define an outer appearance of the lower side of the bottom surface of the cleaner body 110, and as an example, the cover body 161 may include a curved surface.

A plurality of discharge holes 162 may be formed at a center of the cover body 161. The plurality of discharge holes 164 may face the air outlet holes 207 when the battery 200 is accommodated in the battery chamber 170. Inner air of the cleaner body 110 may be discharged to the outside through the plurality of discharge holes 164.

The mounting parts 162 may be provided on opposite sides of the cover body 161, and may extend from the opposite ends of the cover body 161 toward opposite side surfaces of the battery chamber 170, respectively.

The mounting parts 162 may be formed to have a lower extending length that is larger than an upper extending length. Rotation bosses (not illustrated) protruding outward may be provided on lower portions of the mounting parts 162, respectively, and the rotation bosses may be rotatably fastened to opposite side surfaces of the battery chamber 170, respectively. Because the rotation bosses are arranged on opposite sides of the mounting parts 162, an extending line connecting the opposite rotation bosses may be considered as a rotation axis of the battery cover 160.

The lower portions of the mounting parts 162 may be rotatably fastened to lower portions of opposite side walls of the battery chamber 170, respectively. Thus, a lower portion of the battery cover 160 may be fixed to opposite side surfaces of the battery chamber 170, and an upper portion of the battery cover 160 may be vertically rotated about the rotation axis.

Thus, the battery cover 160 may close the opening 171, and may be rotated about the rotation axis to selectively open the opening 171.

While the battery cover 160 is opened, the upper portion of the battery cover 160 is moved in a direction in which it becomes farther away from the opening 171.

A locking part 166 may be provided at an upper portion of the battery cover 160. The locking part 166 is provided in a button scheme, may push the cleaner body 110 when being compressed, and may be caught by one side of the cleaner body 110 when being decompressed.

Figure 12:
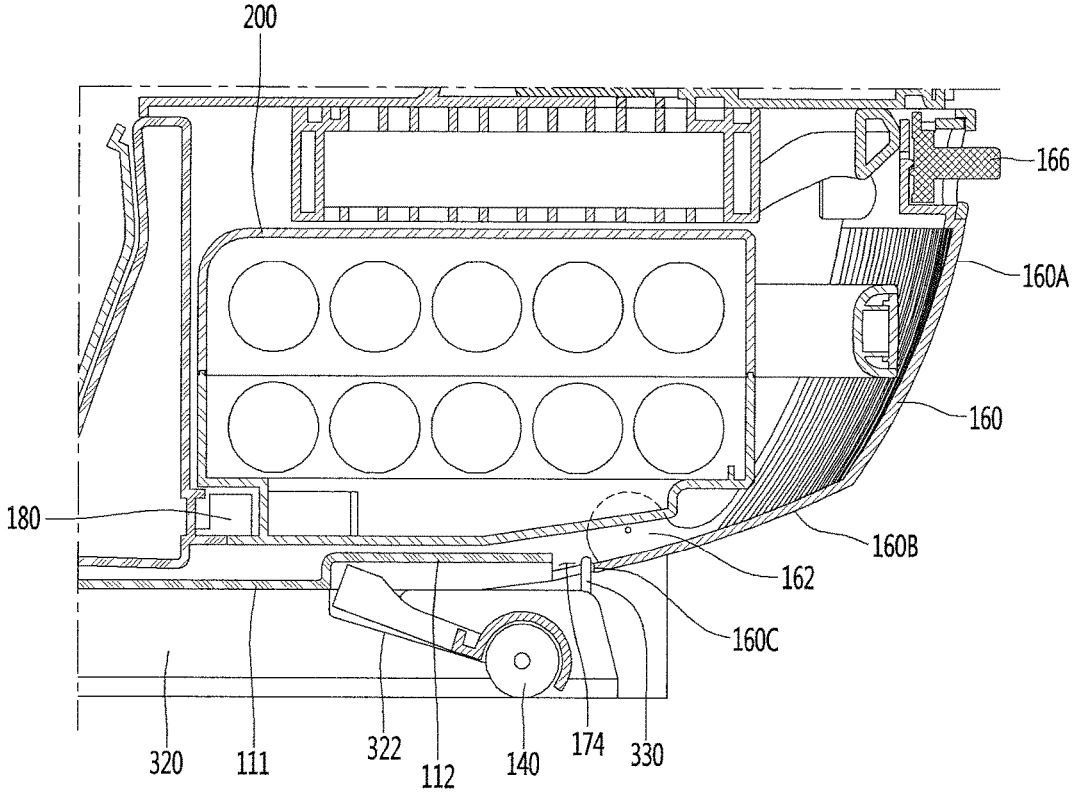
FIG. 12 is a sectional view illustrating the cleaner body coupled to the charging stand according to another embodiment of the present invention.

Meanwhile, when the opening 171 is closed by the battery cover 160, an upper portion 160A of the battery cover 160 may come into contact with an upper edge of the opening 171, and a lower portion 160B of the battery cover 160 may be spaced apart from the bottom surface of the cleaner body 110 in a front-rear direction (see FIG. 12)

A space between a lower end of the battery cover 160 and a bottom surface of the cleaner body may be defined as a space 174 (see FIGS. 7 and 12).

As an example, the space 174 may be a space between the first surface 111 and a lower end of the battery cover 160 or a space between the second surface 112 and the lower end of the battery cover 160.

The space 174 may ensure a rotation radius of the battery cover 160 to make rotation of the battery cover 160 free so as to prevent interference with other components of the battery cover 160.

Figure 10:
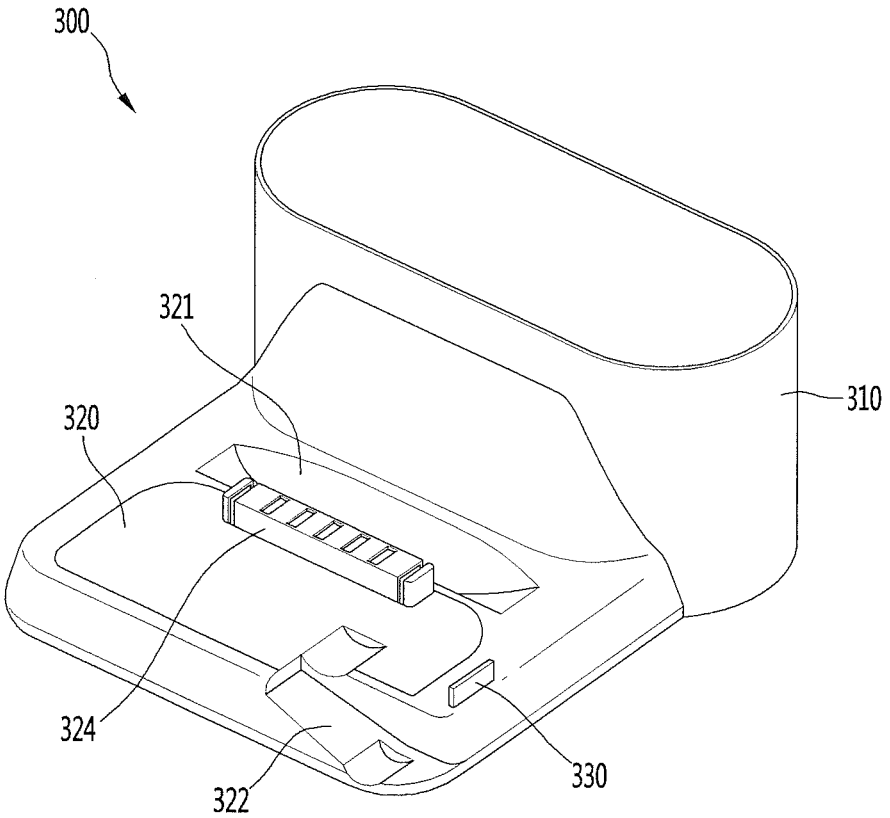
FIG. 10 is a perspective view illustrating a charging stand according to another embodiment of the present disclosure.
Figure 11:
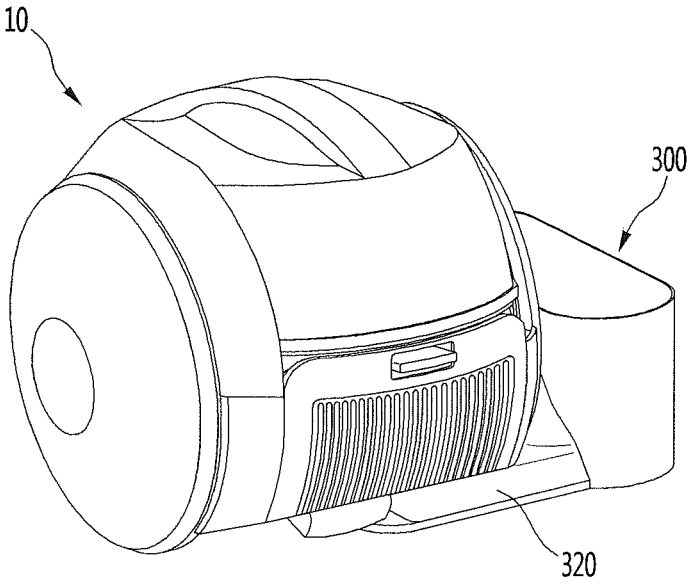
FIG. 11 is a perspective view illustrating the cleaner body coupled to the charging stand according to another embodiment of the present invention.

FIG. 10 is a perspective view illustrating a charging stand according to another embodiment, FIG. 11 is a perspective view illustrating a cleaner body coupled to the charging stand according to another embodiment of the present invention, and FIG. 12 is a sectional view illustrating the cleaner body coupled to the charging stand according to another embodiment of the present invention.

Referring to FIGS. 10 to 12, the cleaner body 110 may be coupled to the charging stand 300 to receive electric power from the charging stand 300.

The charging stand 300 includes a body 310 including a power source device and a holding part 320 on which the cleaner body 110 is held. The body 310 may include a plurality of power source devices.

The holding part 320 may include a first holding part 321 and a second holding part 322.

The holding parts 321 and 322 may be recessed downward from an upper surface by a predetermined distance.

A moving wheel 40 may be seated on the first holding part 321. The supporter 140 may be seated on the second holding part 322.

The output terminal part 324 coupled to the input terminal part 114 may be provided on an upper surface of the holding part 320. The output terminal part 324 may include a plurality of output ports (not illustrated) to correspond to the input terminals 1148. The plurality of output ports may be selectively withdrawn from the output terminal part 324 depending on whether the cleaner body 110 is mounted.

Meanwhile, the battery terminal part of the battery 200 may be coupled to the output terminal part 324. That is, the battery 200 separated from the battery chamber 170 of the cleaner body 110 may be charged through the charging stand 100.

An opening prevention rib 330 for restraining opening of the battery cover 160 may be provided on the upper surface of the holding part 320.

When the cleaner body 110 is held on the holding part 320, the opening prevention rib 330 may be inserted into the space 174.

The opening prevention rib 330 is located on a rotation path of a lower end 160C of the battery cover 160 to restrain rotation of the battery cover 160.

The opening prevention rib 330 is in contact with one end of the battery cover 160 to restrain the rotation of the battery cover 160 so as to prevent the battery cover 160 from being opened.

That is, when the cleaner body 110 is held on the holding part 320, the opening prevention rib 330 prevents opening of the battery cover 160 to prevent the battery 200 from being separated from the battery chamber 170.

Even when the battery 200 is already separated from the battery chamber 170, the opening prevention rib 330 prevents the opening of the battery cover 160 to prevent the charging terminal part 180 from being exposed to the outside.

When the charging terminal unit 180 is not exposed to the outside, a user is prevented from approaching the charging terminal unit 180, so that user's safety is improved.

What is claimed is:

1. A vacuum cleaner system comprising:

a cleaner body that defines a battery chamber;

a motor that is located in the cleaner body and configured to provide a suction force;

a battery that is detachably provided in the battery chamber and configured to provide electric power to the motor;

a battery cover that is rotatably coupled to the cleaner body and configured to open and close the battery chamber; and a charging stand that is configured to couple to the cleaner body, wherein the charging stand includes an opening prevention rib that is located along an opening path of the battery cover to thereby prevent the battery cover from opening based on the cleaner body being coupled to the charging stand.

2. The vacuum cleaner system of claim 1, wherein, the opening prevention rib is located, based on the battery chamber being closed by the battery cover, between the battery cover and a bottom surface of the cleaner body.

3. The vacuum cleaner system of claim 2, wherein the opening prevention rib is configured to contact an end of the battery cover to thereby restrain rotation of the battery cover.

4. The vacuum cleaner system of claim 2, wherein the opening prevention rib protrudes upward from an upper surface of the charging stand.

5. The vacuum cleaner system of claim 1, wherein the battery cover comprises:

a cover body; and a mounting part that extends from an end portion of the cover body and that is rotatably fastened to the battery chamber, wherein the battery cover is configured to rotate about a rotation axis to open and close an opening of the battery chamber.

6. The vacuum cleaner system of claim 1, further comprising a charging terminal unit that is located in the battery chamber and that is configured to be electrically connect to a battery terminal part of the battery.

7. The vacuum cleaner system of claim 6, wherein the charging stand comprises an output terminal unit that is configured to be connected to the battery terminal part of the battery based on the battery being separated from the battery chamber.

8. The vacuum cleaner system of claim 6, wherein the cleaner body comprises an input terminal part at a bottom surface of the cleaner body, wherein the charging stand comprises an output terminal part, and wherein the input terminal part is configured to be connected to the output terminal part based on the cleaner body being coupled to the charging stand.

9. The vacuum cleaner system of claim 1, wherein the cleaner body further comprises movable wheels that are configured to move the cleaner body, and wherein the battery chamber is configured such that a direction in which the battery is inserted into the battery chamber forms an acute angle with respect to a vertical line passing through a rotation center of the movable wheels.

10. A vacuum cleaner comprising:

a cleaner body;

a suction motor that is configured to generate a suction force;

a suction part that is configured to suction in air and dust and communicate with the cleaner body;

movable wheels that is configured to move the cleaner body; and a battery that is detachably mounted at a rear surface of the cleaner body and configured to supply electric power to the cleaner body, wherein the cleaner body is configured to rotate about a rotation center axis of the movable wheels, wherein the cleaner body is configured such that a direction in which the battery is inserted into the cleaner body forms a first acute angle with respect to a vertical line passing through a rotation center of the movable wheels, and a second acute angle with respect to a floor based on the cleaner body being placed on the floor, and wherein the first acute angle is greater than the second acute angle.

11. The vacuum cleaner of claim 10, wherein a center of gravity of the cleaner body is located between a rear of the vacuum cleaner and the rotation center axis based on the battery being coupled to the cleaner body, and wherein the center of gravity of the cleaner body is located between a front of the vacuum cleaner and the rotation center axis based on the battery being separated from the cleaner body.

12. The vacuum cleaner of claim 11, wherein a bottom surface of the cleaner body includes:

a first bottom surface; and a second bottom surface that slopes at a predetermined angle with respect to the first bottom surface, wherein, based on the battery being separated from the cleaner body, the first bottom surface is in contact with the floor and the second bottom surface is spaced apart from the floor.

13. The vacuum cleaner of claim 12, wherein the second bottom surface includes a supporter that is configured to limit a rotation range of the cleaner body toward a rear side of the cleaner body.

14. The vacuum cleaner of claim 13, wherein the supporter includes an auxiliary wheel that is configured to rotate by friction between the auxiliary wheel and the floor.

15. The vacuum cleaner of claim 13, wherein the supporter comprises an extension that is rotatably connected to the cleaner body.

16. The vacuum cleaner of claim 15, wherein the supporter comprises an elastic member that is configured to provide an elastic force to the extension.

17. The vacuum cleaner of claim 13, wherein based on the battery being mounted in the cleaner body, the first bottom surface is spaced apart from the floor and the supporter comes into contact with the floor.

18. The vacuum cleaner of claim 10, wherein the cleaner body comprises a battery attachment part that is configured to couple to the battery, and wherein the battery comprises a battery cover that is configured to cover the battery attachment part based on the battery being accommodated in the battery attachment part.

19. The vacuum cleaner of claim 10, wherein the cleaner body comprises:

a battery attachment part that is configured to couple to the battery is coupled; and a battery cover that is rotatably coupled to the cleaner body and that is configured to cover the battery attachment part based on the battery being accommodated in the battery attachment part.

* * * * *